United States Patent [19]

Biancucci

[11] Patent Number: 4,798,550

[45] Date of Patent: Jan. 17, 1989

[54] FLOATING DEVICE FOR SUPPORTING A SWIMMER FLOATING ON THE WATER EVEN IN RESTING POSITION

[76] Inventor: Cesare Biancucci, Via Verdi, 4, 63022 Falerone (AP), Italy

[21] Appl. No.: 918,969

[22] Filed: Oct. 15, 1986

[51] Int. Cl.[4] ..... A63B 31/00

[52] U.S. Cl. ..... 441/129; 441/130; 272/71

[58] Field of Search ..... 441/129, 130, 55; 114/264, 265, 266, 267; 135/67, 74, 75; 446/153; 273/1 L; 272/1 B, 32, 70.3, 71, 24, 61, 85; 280/87.2; 297/5

[56] References Cited

U.S. PATENT DOCUMENTS

| | | | |
|---|---|---|---|
| 2,997,299 | 8/1961 | Wilkins | 441/130 |
| 3,161,897 | 12/1964 | Hill | 441/130 |
| 3,966,202 | 6/1976 | Cynamon | 272/71 |
| 4,530,497 | 9/1985 | Moran | 272/71 |

FOREIGN PATENT DOCUMENTS

| | | | |
|---|---|---|---|
| 331265 | 10/1935 | Italy | 441/130 |
| 20337 | 11/1934 | United Kingdom | 441/130 |

*Primary Examiner*—Sherman D. Basinger
*Assistant Examiner*—Clifford T. Bartz
*Attorney, Agent, or Firm*—Beveridge, DeGrandi & Weilacher

[57] ABSTRACT

A floating swimmer-supporting device includes a tubular pyramidical structure. The sloping edges of the pyramidial structure are telescopic tubes which are foldable towards each other when the device is collapsed for transportion and storage. Floats are hingedly attached to the outer ends of the tubes. The swimmer wears a belt or jacket which is suspended from the top of the structure.

4 Claims, 1 Drawing Sheet

FLOATING DEVICE FOR SUPPORTING A SWIMMER FLOATING ON THE WATER EVEN IN RESTING POSITION

BACKGROUND OF THE INVENTION

The present invention concerns a floating device that will support on the water surface a swimmer even in resting position.

It is already known that those people not skilled in swimming, or elderly people or children, even if they are able to float for short periods, do often not dare to swim away from the shore to clean, calm, uncrowded waters because they are afraid of not being able to stay afloat for the period needed for swimming back.

It is the aim of the present invention to allow all swimmers to swim far out in great safety in seas, lakes and similar bodies of water, so they can rest in the water where and how long they wish to, taking a breath without any energy consumption.

The aim set forth is reached by means of the device according to the present invention, consisting in a tubular, pyramid-shaped structure, that may be collapsed like a telescope and folded. Once opened, it may float on the water surface due to preferably spheric floats provided out of one piece at the lower end of the telescopic tubes forming the edges of said pyramid, so as to support the swimmer by means of a belt or a jacket or similar suspended at the top thereof along the vertical. This enables the swimmer, even without doing any movement, to remain suspended in a partial immersion in a comfortable relaxed position.

The advantages of the present invention are obvious. The tubular structure of the device does not hinder the visibility of the swimmer in any direction and furthermore, said structure is so light that it may be displaced on the water surface without any energy consumption, just pulled by the swimmer himself by means of ropes or similar connecting members extending between the support belt and the floats.

BRIEF DESCRIPTION OF THE DRAWINGS

The present invention will be described more in detail hereinbelow according to the enclosed drawings, showing a preferred embodiment thereof, and in which the figures show.

DETAILED DESCRIPTION

Figures 1, 2, 3, 4:
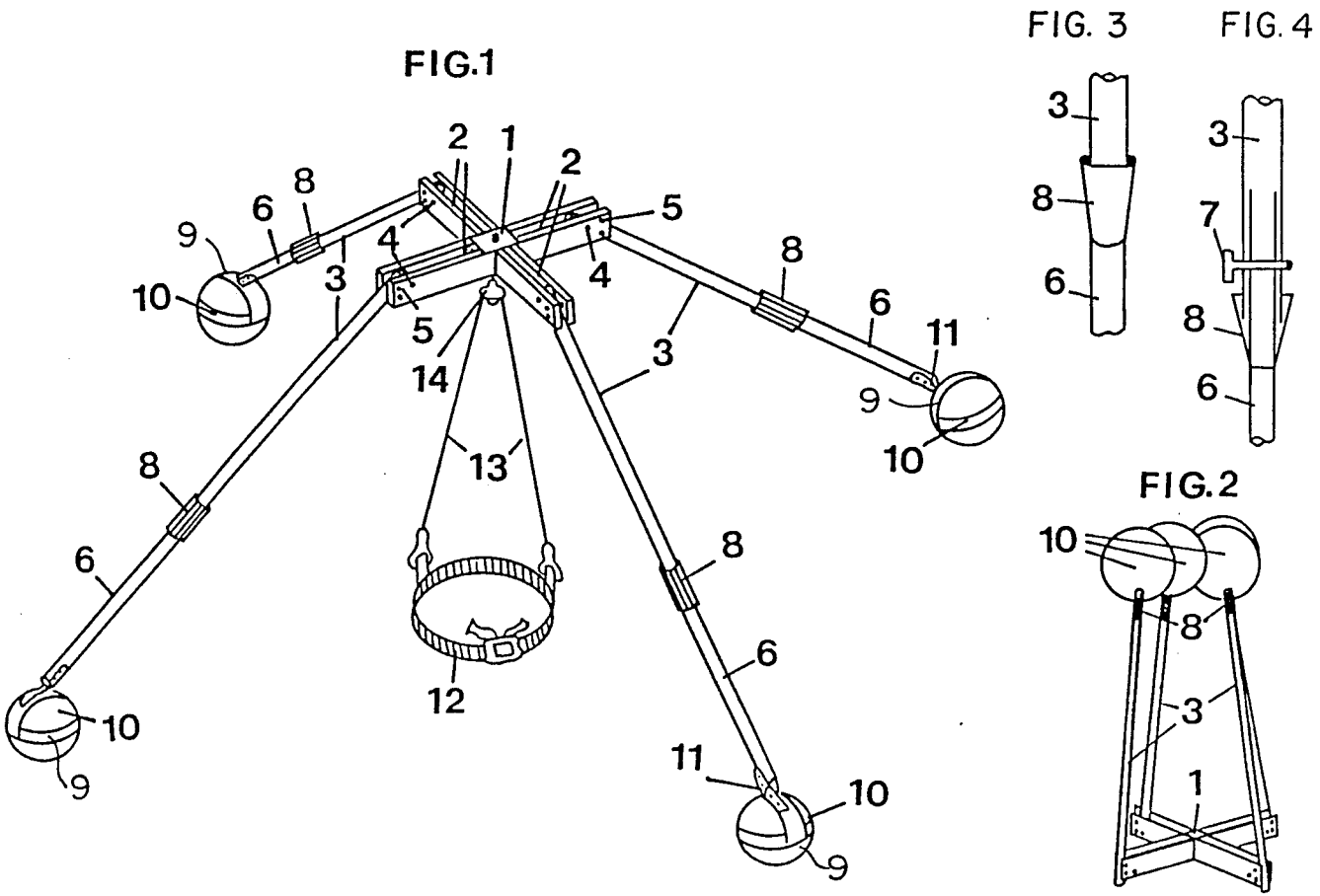
FIG. 1, an axonometric view of a complete device according to the present invention, open for use.
FIG. 2 shows the device collapsed and folded for transport and storing.
FIG. 3 is an enlarged view showing the sleeve at the fastening point between two tubes.
FIG. 4 shows, in schematic vertical section, the fastening element of the telescopic tubes.

The figures show the floating device for supporting a swimmer on the water surface, comprising:

an upper cross 1 with four arms 2, each having two parallel rigid plates;

four tubular elements 3 pivoted at 4 to the inner end of the two rigid plates forming each of said arms 2;

four stop elements 5 that are inserted in said arms 2 so as to keep, during use, said tubular elements 3 in their truncated-pyramidal position. While disassembling, however, the removal of said arrest elements 5 allows the upward folding of said tubular elements 3;

four telescopic tubular elements 6 that will move into said tubular elements 3 during transport and storing, and that may be pulled out when erecting said device. As shown in FIG. 4, the tube 6 is blocked by a transverse pin 7 and is covered by sleeve 8;

four spheric float means 10 each placed in containing structure 9, connected to the lower end of said telescopic tubular elements 6, movable around hinge 11;

a jacket or belt 12 that is a swimmer-engaging device which is worn by the swimmer; and tension rods 13 which provide suspension means support the jacket or belt 12 from a suspension pin 14 placed in the center of said cross 1.

Said belt 12, once worn by the swimmer, is kept at the level of the water surface thus supporting the swimmer at the water level.

Tension rods 13 serve to pull the floating device during the movements of the swimmer.

It is obvious that, once disassembled as shown in FIG. 2, the device according to the present invention takes very little space for transport and storing, due to the insertion of telescopic tubular elements 6 into elements 4, and to the rotation of element 3 around the hinges 4 without the limits of the stop elements 5 which have been taken off by the swimmer.

I claim:

1. A floating device for supporting a swimmer on the water surface and in a resting position, comprising,
   - an upper cross with four arms which each have two parallel rigid plates;
   - four tubular elements each being hinged between the two rigid plates forming one of said arms;
   - four lock elements inserted in said arms so as to keep said tubular elements in positions where they together define a truncated-pyramidal form when the device is in use, said lock elements being removable for collapse of the device to allow the upward folding of said tubular elements;
   - four telescopic elements which are telescoped on said tubular elements for transport and storing and are extendible for use of said device, a transverse pin for locking each telescopic element to its respective tubular element;
   - four float means for floating on the water surface, said float means being mounted in containing structures which are connected to the lower ends of said telescopic elements,
   - a jacket or belt that is worn by the swimmer, a suspension pin placed in the center of said cross, and suspension means for suspending the jacket or belt from the suspension pin, said suspension means being at a level which keeps the jacket or belt worn by the swimmer at the level of the float means which are floating on the water surface.

2. A floating device according to claim 1 wherein the floats are spherical.

3. A floating device according to claim 1 wherein the telescopic elements have lower ends which are unconnected to each other.

4. A floating device according to claim 1 wherein, in a horizontal plane defined by said floats, the only elements are said floats and said jacket or belt.

* * * * *